United States Patent [19]

Saunders

[11] 4,026,140

[45] May 31, 1977

[54] FACILITATING REMOVAL OF DEEP DRAWN SHEET METAL CAN BODIES FROM FEMALE DIE STRUCTURE

[75] Inventor: William T. Saunders, Weirton, WV

[73] Assignee: National Steel Corporation, Pittsburgh, Pa.

[22] Filed: Feb. 23, 1976

[21] Appl. No.: 659,993

[52] U.S. Cl. ..... 72/344; 72/347

[51] Int. Cl.[2] ..... B21D 22/20

[58] Field of Search ..... 72/344, 345, 347, 350, 72/351, 358, 467; 113/120 H

[56] References Cited

UNITED STATES PATENTS

| | | | |
|---|---|---|---|
| 346,522 | 8/1886 | White | 72/344 |
| 2,324,205 | 7/1943 | Gladfelter et al. | 113/120 H |
| 2,373,606 | 4/1945 | Slater | 72/349 |
| 3,664,172 | 5/1972 | Cvacho | 72/350 |

*Primary Examiner*—Lowell A. Larson
*Attorney, Agent, or Firm*—Shanley, O'Neil and Baker

[57] ABSTRACT

In the deep drawing of unitary can bodies, method and apparatus which reduce frictional contact of the can body sidewall with the female die opening to permit removal of the drawn can body from the female die in the direction of removal of the male punch member without damage to the can body. Deep drawing of organically coated sheet metal stock and removal from the female die structure is also made possible while maintaining desired protection. Smooth, non-reentrant sidewall surfaces are maintained in the work product.

5 Claims, 3 Drawing Figures

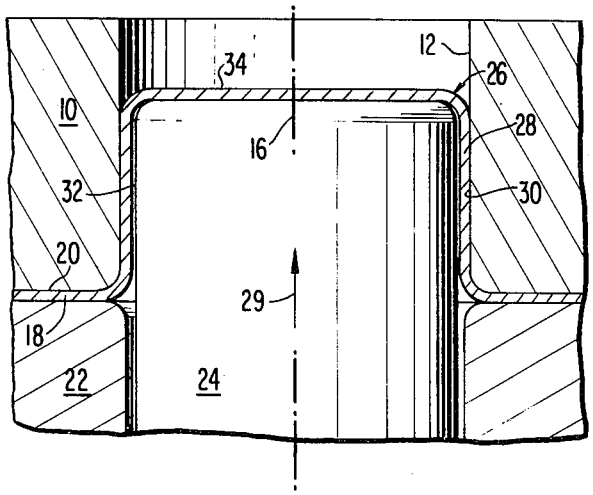
FIG. 1
PRIOR ART
FIG. 2
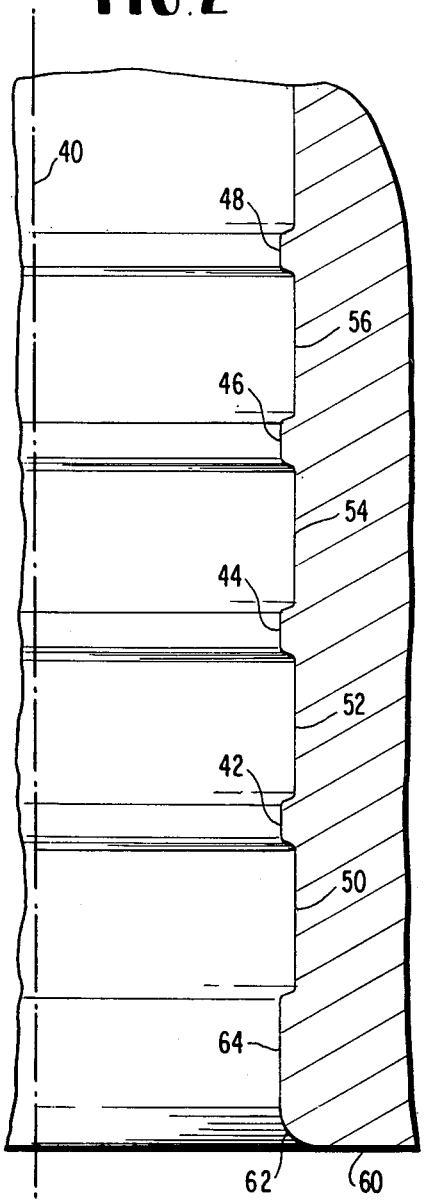
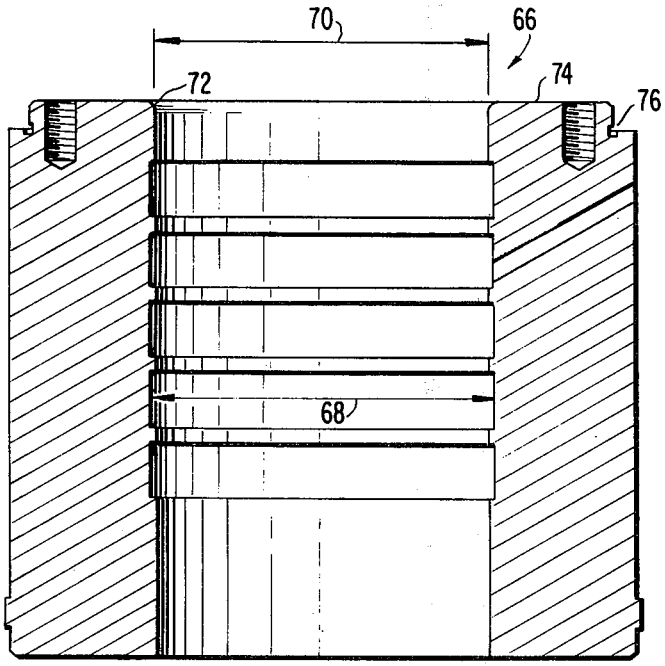
FIG. 3

FACILITATING REMOVAL OF DEEP DRAWN SHEET METAL CAN BODIES FROM FEMALE DIE STRUCTURE

This invention relates to deep drawing of a unitary sheet metal can body having a smooth surface cylindrical sidewall and facilitating removal of such a deep drawn can body from the female die structure after the draw step.

Unitary can bodies have been used for commercial manufacture of small containers requiring a relatively shallow draw, about 1½ inches (3.8 cm) and having a diameter of at least twice the draw height. However, with the deep drawing operation required for unitary can bodies of greater sidewall heights, e.g. about 3 inches (7.62 cm) where the height to diameter ratio approaches one, difficulties are encountered which have inhibited wide commercial usage of unitary can bodies of extended sidewall height.

During the drawing step required for such extended-height can bodies it has been found that the sidewall sheet metal bulges outwardly causing it to "hug" the internal surface of the female die opening. This creates high surface friction between the external sidewall surface of the drawn can body and the interior sidewall surface of the female die such that the can body cannot be readily removed without damage to the unitary end-wall.

The present invention reduces the sidewall frictional contact in deep drawing a longitudinally extended sidewall for a unitary sheet metal can body while maintaining the desired smooth, non-reentrant sidewall characteristics. Also, removal of can bodies drawn from organically coated sheet metal stocks is made possible while maintaining desired organic coating.

These and other contributions of the present invention will be more evident from a description of drawing die structure shown in the accompanying drawings. In these drawings:

FIG. 1 is a schematic cross-sectional view of a drawing operation showing the interrelation of male, female, and clamping structure with the female die opening of the prior art;

FIG. 2 is a partial cross-sectional view of die structure embodying the invention; and FIG. 3 is a cross-sectional elevational view of structure embodying the invention.

In drawing operations to form a cup-shaped can body, a sheet metal blank is held about its periphery between the clamping surfaces of the female die means and a clamping ring on the male side of the structure. This clamping action is shown in FIG. 1 which depicts the general relationship of the die structure parts and the sheet metal during the drawing operation to form a cup-shaped can body.

In FIG. 1, female die structure 10 includes an internal cylindrically shaped surface 12 defining a die opening which is concentric with central longitudinal axis 16. The sheet metal is clamped around its periphery 18 between a female die clamping surface 20 and clamping ring 22 on the male side. Male die plunger 24 is moved in a direction coincident with the central longitudinal axis during its work stroke into the female die opening and the sheet metal takes on the cup-shaped configuration 26.

Changing the sheet metal from a substantially flat configuration to a cylindrical configuration requires large forces to be applied against the internal surface bottom wall. As a result, there may be a "spring-back" or "memory" action in the sheet metal tending to return to its original shape after the work stroke stops, which causes the sidewall sheet metal to bulge against the female die opening. The male plunger, on the other hand, can generally be withdrawn with little or no resistance.

As indicated by FIG. 1, a tight frictional contact of sidewall 28 with working surface 30 of the female die opening results when deep drawing a can body while a loose relationship exists between the external sidewall surface of the male die plunger 24 and the sheet metal. Such tight-adherence, high-friction contact between the internal surface of a prior art female die opening and the external surface of the can body holds the can body in such female die structure while the male plunger is removed. In drawing steel can bodies when the height of the sidewall exceeds half the diameter of the cup-shape and especially in drawing sheet metal of thickness gages commonly used for can bodies of 3 inches (7.62 cm) and greater sidewall heights, the forces required for removal of such can bodies in the direction of withdrawal of the male punch are such that damage results in an unacceptable percentage of product. Removal in the direction of withdrawal of the male die plunger is required for most food pack can bodies in order to provide flanging metal for double-seam joinder of a closure to the open end of the can body.

In FIG. 1 the direction of the work stroke is indicated by arrow 29. Because of the loose relationship with the male die plunger 24, its withdrawal opposite to the direction of arrow 29 is not of significant help in removing the drawn product. Removal must take place by force being applied to the external surface 34 of the bottom wall of can body 26. This not only resulted in damage to an unacceptable percentage of uncoated sheet metal can bodies but ruled out precoating with organic coatings because of damage to such coatings.

The invention teaches a reduction in this sidewall frictional contact along the internal sidewall of the female die opening while maintaining sufficient surface contact for drawing the sidewall to produce the desired smooth, non-reentrant sidewall surface characteristics. The male die member and clamping structures used in the invention are not significantly changed from those shown schematically in FIG. 1; nor are the metal chemistry and physical properties of the tool used for manufacturing the female die structure of the invention changed significantly from those generally known and accepted in the art.

FIG. 2 shows a portion of the female die structure of the invention, on one side of the central longitudinal axis 40, in enlarged cross section. The internal surface of the opening of this female die structure is formed with a series of raised, ring-shaped, cylindrical surface portions 42, 44, 46 and 48 distributed longitudinally along the working surface of the die opening; these provide a female drawing surface of substantially reduced area. Such raised portions are separated by a series of recessed portions 50, 52, 54 and 56 of ring-shaped cylindrical configuration, which support the raised portions 42, 44, 46, and 48 without frictional contact with the work product.

The female die structure includes clamping surface 60, entry radius 62, and a cylindrical entry portion 64 having substantially the desired diameter for the external surface of the can body being drawn. The diameter of entry portion 64 is the same as that of raised portion 42, 44, 46 and 48.

The longitudinal dimension of the raised portions 42, 44, 46 and 48 is selected to provide the necessary support to the can body sidewall during drawing in order to produce a smooth non-reentrant sidewall. The longitudinal dimension of a recessed portion is a multiple of the longitudinal dimension of a raised portion; such multiple extending from about five to about 30 times the longitudinal dimension of the surface contact of a raised portion. In a typical example, the recessed ring shaped portions would have a longitudinal dimension of ½ inch (1.25 cm), the cylindrical portion 64 at the entry end of the die would have a longitudinal dimension of about ½ inch (1.25 cm), and the raised ring shaped portions would have a longitudinal dimension between 1/64 inch and ⅛ inch (0.39 mm and 3.18 mm). For a 5 inches (11.7 cm) diameter can body, the entry portion and raised ring shape portions of the die would have a diameter of about 5.010 inches (11.725 cm), and the recessed portions a diameter of 5.015 inches (11.738 cm).

Considering typical dimensions for a smaller diameter can body: in the female die structure 66 of FIG. 3 (entry from above) the recessed ring shaped diameter 68 has a dimension of 2.877 inches (7.307 cm) and the entry portion and raised ring shaped portions diameter 70 has a value of 2.875 inches (7.302 cm). Die structure 66 includes clamping surface 74 and recess means 76 for holding the die structure in the drawing machinery (not shown).

While the features of the invention have application where the depth of draw exceeds half the diameter, its contributions are more pronounced in drawing a cup shape where ratio of the sidewall height to the diameter equals or exceeds one, especially where the sidewall height of a can body is 4 inches (10.16 cm) or longer.

Removal of can bodies drawn from sheet metal precoated with conventional organic coatings, e.g. vinyls, epoxies, phenolics and acrylics, is made possible by the present invention. Organic coating of flat rolled stock can be carried out in continuous strip lines. After cutting into blanks, the coated blanks are drawn in the described die structure. The reduction of surface friction provided enables removal of the coated drawn cup shape, in the direction of withdrawal of the male punch, while maintaining the protective and/or decorative coating on both surfaces of the can body. The organic coating is maintained on the external surface of the can body sidewall without damage as a result of removal from the female die opening.

The invention in addition to being useful in the drawing of steel thickness gages for can bodies between about 0.0065 inches and about 0.011 inches (about 0.15 mm to about 0.28 mm) is also applicable in the drawing of aluminum can bodies typically having gages between 0.007 inches (0.178 mm) and 0.015 inches (0.374 mm). Other configurations and interrelations of dimensions are available than those specifically set forth; therefore the scope of the invention is to be determined from the appended claims.

What is claimed is:

1. Deep drawing die means for drawing a sheet metal blank into a cup-shaped can body and facilitating removal of the can body after drawing, such can body having a smooth, non-reentrant, cylindrical-configuration sidewall and a unitary endwall with the longitudinal dimension of such sidewall being at least twice the diamedral dimension of the can body, comprising male die means including an elongated cylindrical configuration plunger having a smooth exterior sidewall surface uniformly spaced from its central longitudinal axis which is coincident with the longitudinal direction of movement of such plunger during its work and withdrawal strokes, female die means defining an elongated die opening, such die opening presenting an interior sidewall having a central longitudinal axis which is coincident with the longitudinal direction of relative movement of the male die plunger into the female die opening, the interior sidewall of the female die opening having a minimum diamedral dimension accommodating the male die means and sheet metal being drawn into a cup-shaped can body having a thickness gage between about 0.15 and about 0.4 mm, the interior sidewall of the female die opening having a working surface defining a series of ring-shaped raised portions longitudinally distributed along such working surface, successive raised portions being separated by a recessed ring-shaped portion, such recessed portions being longitudinally distributed along such working surface, the longitudinal dimension of such raised ring-shaped portions being selected to provide support to the can body sidewall during drawing to provide a smooth, non-reentrant exterior surface on such can body sidewall with the recessed ring-shaped portions diminishing surface contact between the interior sidewall of the female die opening and the exterior surface of the drawn can body sidewall so as to facilitate removal of the can body in the direction of withdrawal of the male die plunger, such recessed ring-shaped portions having a longitudinal dimension which is a plurality of times greater than the longitudinal dimension of such raised ring-shaped portions.

2. The structure of claim 1 in which the interior diamedral dimension of such recessed ring-shaped portions is at least 0.05 mm greater than that of such raised ring-shaped portions.

3. The structure of claim 1 in which the raised ring-shaped portions and intermediate recessed portions are distributed uniformly longitudinally on the working surface of the female die opening.

4. Method for reducing surface contact friction in the deep drawing of a sheet metal cup-shaped can body having a longitudinally extended cylindrical sidewall with a smooth non-reentrant surface and a unitary endwall so as to facilitate drawing and post-drawing removal of the can body comprising the steps of providing a sheet metal blank of a thickness gage between about 0.15 mm and about 0.4 mm, providing drawing apparatus including male die means, female die means, and sheet metal clamping means for clamping the sheet metal blank during a drawing operation, the male die means including a cylindrical configuration male die plunger having a smooth exterior surface uniformly spaced from a central longitudinal axis, the female die means defining a female die opening having an interior sidewall surface concentric with a central longitudinal axis, the male die means and female die means being mounted with their central longitudinal axes coincident forming a common central longitudinal axis providing for movement of the male die plunger into the female die opening, placing the sheet metal blank along a plane perpendicular to such common central longitudinal axis between the withdrawn male die plunger and the female die means, clamping the sheet metal blank about the periphery of the female die opening, providing an interior sidewall surface on the female die opening comprising a series of raised ring-shaped portions separated longitudinally by a series of recessed ring-shaped portions, such raised and recessed ring-shaped portions being distributed longitudinally along the work surface of the interior sidewall of the female die opening over substantially the full length of such work stroke, moving the male die plunger in a direction along the central longitudinal axis to draw the sheet metal blank into the female die opening to form a cup-shaped article having flanging metal at its open longitudinal end, the dimensions of the raised portions and the recessed portions, and their distribution along the work surface of the female die opening being such that the raised portions support the can body sidewall during drawing and the recessed portions reduce frictional contact between the exterior surface of the can body and the interior surface of the die opening sidewall, withdrawing the male die plunger from the female die opening, and removing the drawn cup-shaped article from the female die opening in the direction of withdrawal of the male die plunger.

5. The method of claim 4 including the step of coating the flat rolled sheet metal prior to drawing with an organic coating, the removal step being carried out while maintaining such organic coating on the external surface of the can body sidewall.

* * * * *